US010465887B1

(12) United States Patent
Levy et al.

(10) Patent No.: US 10,465,887 B1
(45) Date of Patent: Nov. 5, 2019

(54) CAP LIGHT

(71) Applicant: Navajo Manufacturing Company, Inc., Denver, CO (US)

(72) Inventors: Gordon Levy, Golden, CO (US); Shawn A. Shelton, Highlands Ranch, CO (US)

(73) Assignee: Navajo Manufacturing Company, Inc., Denver, CO (US)

( * ) Notice: Subject to any disclaimer, the term of this patent is extended or adjusted under 35 U.S.C. 154(b) by 0 days.

(21) Appl. No.: 16/156,593

(22) Filed: Oct. 10, 2018

(51) Int. Cl.
*F21V 21/14* (2006.01)
*F21V 21/096* (2006.01)
*F21V 21/30* (2006.01)
*F21V 21/088* (2006.01)

(52) U.S. Cl.
CPC ..... *F21V 21/145* (2013.01); *F21V 21/0885* (2013.01); *F21V 21/0965* (2013.01); *F21V 21/30* (2013.01)

(58) Field of Classification Search
CPC ..... F21V 21/145; F21V 21/0885; F21V 21/0965; F21V 21/30
See application file for complete search history.

(56) References Cited

U.S. PATENT DOCUMENTS 1,283,566 A 11/1918 Rosenfeld
D188,129 S 6/1960 Wansky et al.
3,032,647 A 5/1962 Wansky et al.
3,601,595 A 8/1971 Kivela
4,827,384 A 5/1989 Von Schlemmer
5,515,249 A 5/1996 Shiao
5,558,429 A 9/1996 Cain
5,592,066 A 1/1997 Fan
6,015,217 A 1/2000 Colangelo et al.
D447,586 S 9/2001 Shing
6,467,929 B2 10/2002 Lee
6,793,366 B2 9/2004 Chun
D507,065 S 7/2005 Son
7,118,241 B2 10/2006 Sohn
7,163,309 B2 1/2007 Sohn
D544,121 S 6/2007 Yang
D553,279 S 10/2007 Yang
D564,685 S 3/2008 Schnell
7,427,149 B2 9/2008 Sohn
7,506,992 B2 3/2009 Carter
D590,975 S 4/2009 Ma
7,708,422 B2 5/2010 Sohn
D637,330 S 5/2011 Lee
8,002,437 B2 8/2011 Sohn
8,157,403 B2 4/2012 Lau
8,403,518 B2 3/2013 Sohn
D679,435 S 4/2013 Sohn
8,562,170 B2 10/2013 Sohn
2005/0047124 A1* 3/2005 Hsien ..... B25B 23/18 362/188

FOREIGN PATENT DOCUMENTS

WO 2009002082 A2 12/2008

* cited by examiner

*Primary Examiner* — Anne M Hines
(74) *Attorney, Agent, or Firm* — Studebaker & Brackett PC

(57) ABSTRACT

A flashlight may be mounted on a hat or cap, positioned on a surface with any desired directionality and be secured to a metallic object by a magnet. A mounting clip is secured to the body of the flashlight and is rotatable and pivotable with respect to the body of the flashlight.

17 Claims, 5 Drawing Sheets

FIG. 1
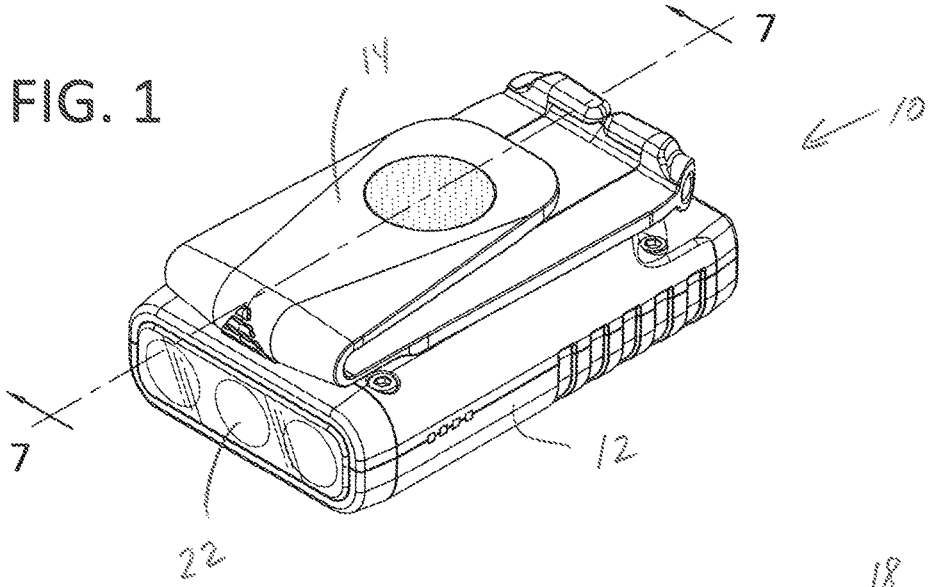
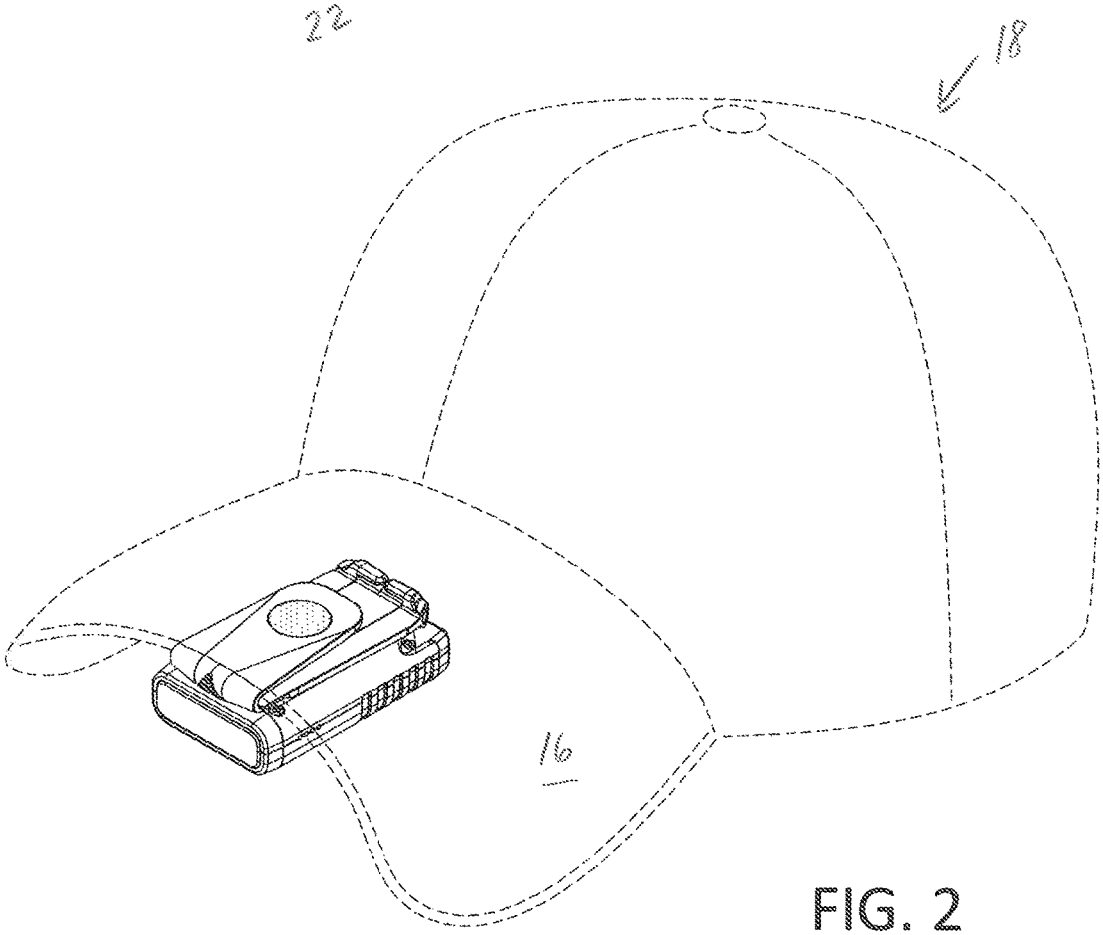
FIG. 2

FIG. 3
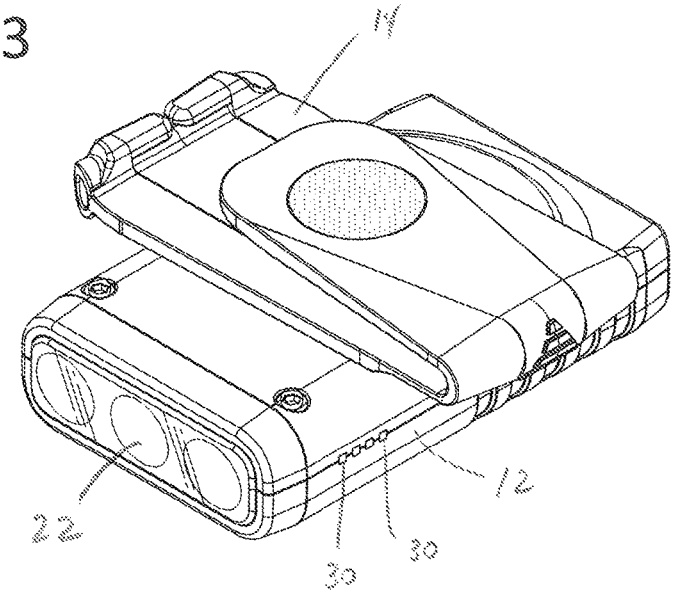
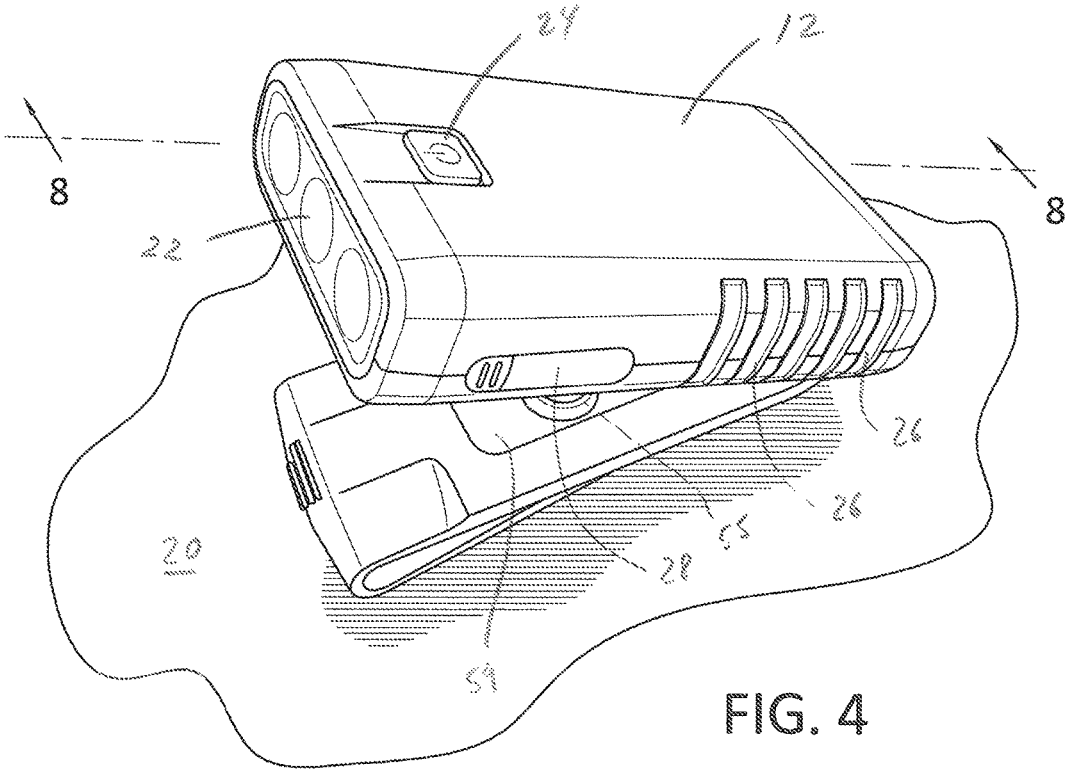
FIG. 4

CAP LIGHT

FIELD OF THE INVENTION

The present invention relates to a light for placement on a cap or hat, on a flat surface or attached to a metallic object by way of a magnet. The light is pivotable and rotatable for desired directionality.

BACKGROUND OF THE INVENTION

Traditional flashlights are normally handheld and include a single direction of illumination. These flashlights must be supported on angled surfaces for varying a direction of illumination.

Accordingly, it would be advantageous to have a flashlight which may be positioned at a desired angle for illumination of all desired objects when mounted on a hat, a flat surface and/or a metallic object.

SUMMARY OF THE INVENTION

By the present invention, a flashlight may be mounted on a hat or cap, positioned on a surface with any desired directionality and be secured to a metallic object by a magnet. A mounting clip is secured to the body of the flashlight and is rotatable and pivotable with respect to the body of the flashlight.

Accordingly, it is an object of the present invention to provide a flashlight body having an omnidirectional mounting clip.

It is another object of the present invention to provide a flashlight body having an omnidirectional mounting clip with the clip being rotatably mounted on the flashlight body by a snap ring and being pivotable with respect to the flashlight body through angular increments of engagement with a plurality of teeth of a ratchet and pawl assembly.

It is still yet another object of the present invention to provide a flashlight body having an omnidirectional mounting clip with the clip being rotatably mounted on the flashlight body by a snap ring and being pivotable with respect to the flashlight body through angular increments of engagement with a plurality of teeth of a ratchet and pawl assembly, with a magnet of the clip engageable with metallic surfaces.

It is still another object of the present invention to provide a flashlight body having an omnidirectional mounting clip with the clip being rotatably mounted on the flashlight body by a snap ring and being pivotable with respect to the flashlight body through angular increments of engagement with a plurality of teeth of a ratchet and pawl assembly, with a magnet of the clip engageable with metallic surfaces, and the clip being engageable with a flat surface for supporting the flashlight at a desired angle or direction.

These and other objects of the invention, as well as many of the intended advantages thereof, will become more readily apparent when reference is made to the following description taken in conjunction with the accompanying drawings.

BRIEF DESCRIPTION OF THE DRAWINGS

The following drawings illustrate examples of various components of the invention disclosed herein, and are for illustrative purposes only. Other embodiments that are substantially similar can use other components that have a different appearance.

FIG. 1 illustrates a perspective view of a cap light of the present invention.

FIG. 2 illustrates the light being mounted onto the brim of a hat or cap.

FIG. 3 illustrates a clip rotatably mounted on a body of the flashlight being positioned at 90° with respect to the body.

FIG. 4 illustrates the clip being moved angularly with respect to the flashlight body for mounting the flashlight body on a flat surface and the desired angle.

DETAILED DESCRIPTION OF THE PREFERRED EMBODIMENTS

Figure 5:
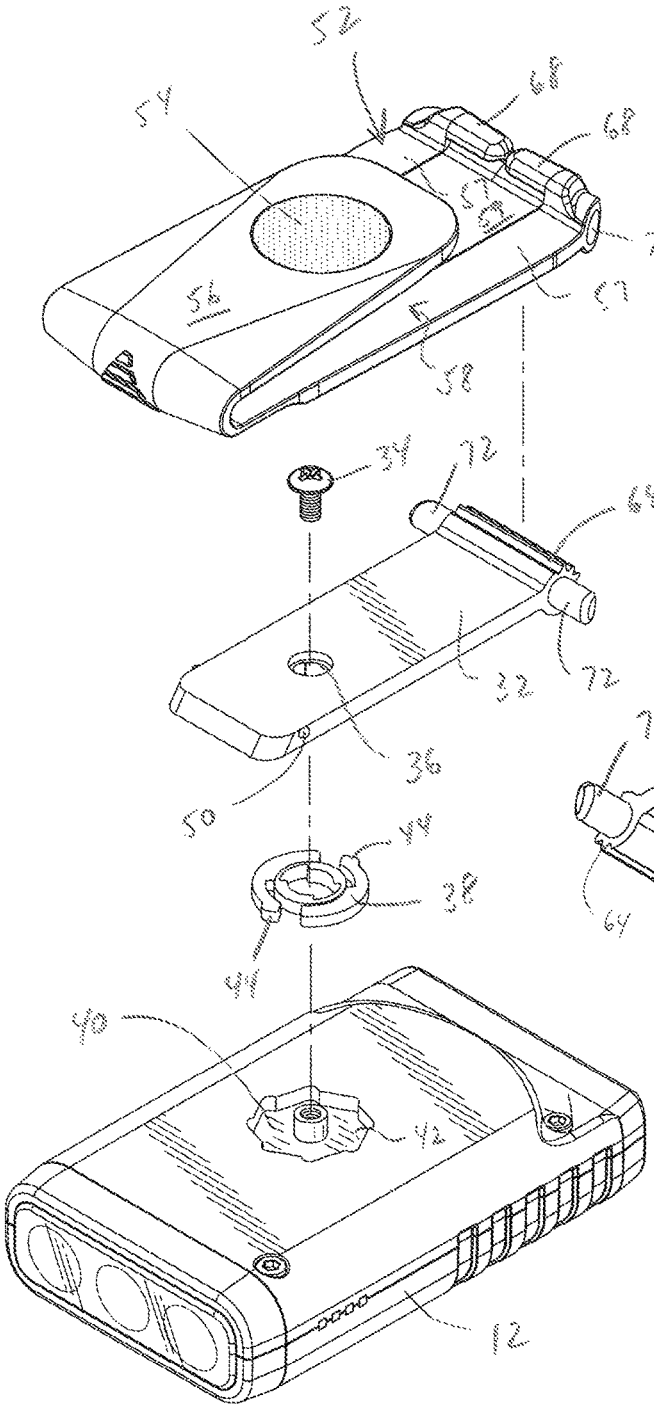
FIG. 5 is an exploded view of the clip and the flashlight body.

In describing a preferred embodiment of the invention illustrated in the drawings, specific terminology will be resorted to for the sake of clarity. However, the invention is not intended to be limited to the specific terms so selected, and it is to be understood that each specific term includes all technical equivalents which operate in a similar manner to accomplish a similar purpose.

As shown in FIGS. 1 through 4, a flashlight 10 includes a body 12 and clip 14. The clip facilitates the mounting of the flashlight onto the brim 16 of a hat 18 as shown in FIG. 2. This allows for the hands-free use of the flashlight while the flashlight is mounted on a hat.

The clip 14 is rotatable with respect to the body 12 in 45° increments. As shown in FIG. 3, the clip is rotated 90° with respect to the body of the flashlight. Also, the clip is pivotal on the flashlight body in 30° increments. A 30° elevation of the flashlight body from a flat surface 20 is shown in FIG. 4. This allows for pointing of the light source 22 at a desired angle. While three LEDs are shown for the light source 22 in the figures, it is understood as being within the scope of the present invention that the light source may be a single LED or bulb or other arrangement commonly available for flashlights.

The flashlight body 12 includes a power button cover 24 for activating the four stages of illumination of the flashlight. The four stages include a highest brightness, a lowest brightness, flashing light and off position. The flashlight body also includes textured indents 26 for grip of the body. A removable cover 28 exposes a USB-C charging port, when rechargeable batteries are used. Charging light indicators 30 indicate battery charge levels by 25% increments, with all four lights being lit when the battery is fully charged. The charging port may also be used as a power source for charging external equipment such as a cell phone.

For rotation of the clip with respect to the flashlight body 12, reference is made to FIG. 5. In this figure, a plate 32 of the clip is secured to the flashlight body 12 by a screw 34 passing through an opening 36 in the plate 32. The screw 34 passes through a snap ring 38 which is bi-directionally secured in a recess 40 of the flashlight body. An undulating outermost surface 42 of the recess 40 provides engagement surfaces for the biased terminal ends 44 of the snap ring 38 to seat the ends 44 in position. This facilitates the rotation of the plate 32 in 45° increments with respect to the flashlight body 12.

Figure 6:
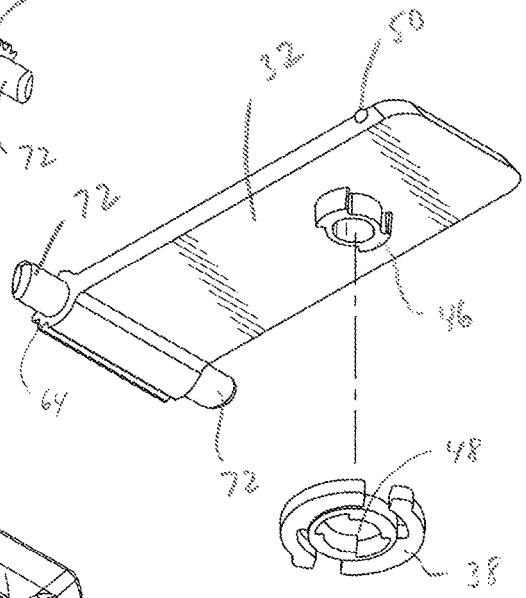
FIG. 6 is an exploded underside view of a portion of the clip used to mount the clip onto the flashlight body.

As shown in FIG. 6, the underside of the plate 32 includes an extrusion 46 for fitting within the central complementary shaped opening 48 of the snap ring 38 so as to lock the plate 32 in the snap ring 38. The plate 32 also includes small extrusions 50 for locking with corresponding recesses of another portion 52 of the clip 14.

The portion 52 is U-shaped, having two interconnected legs, and includes a magnet 54 in flat upper surface 56. This allows engagement of the portion 52 with a metallic object and securing the position of the flashlight. The bottom portion 58 of U-shaped portion 52 provides a gap 61 spaced from upper surface 56 for sliding of the assembly onto the brim of a hat, for example.

Figure 7:
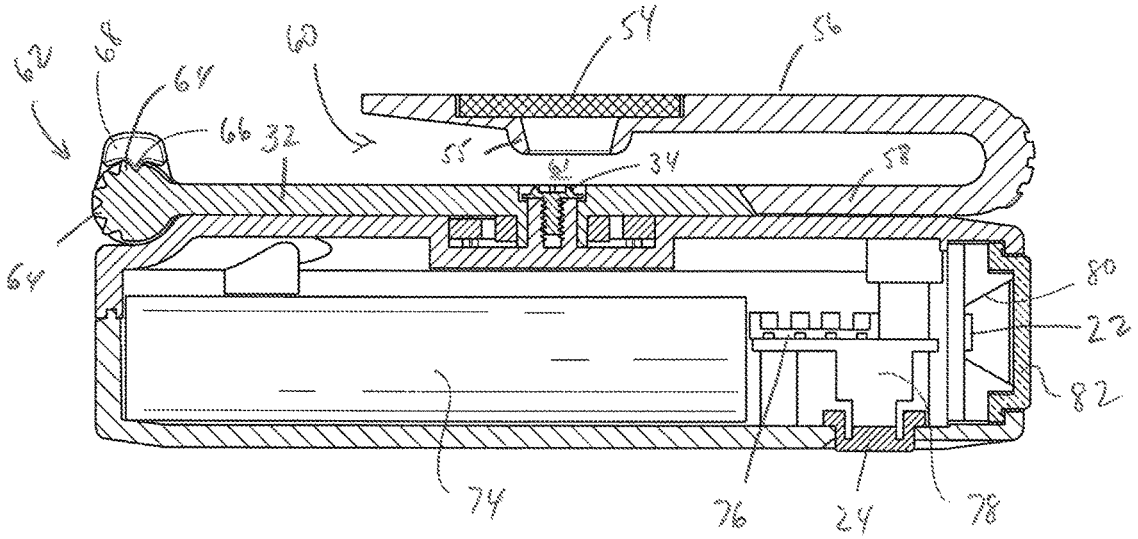
FIG. 7 is a cross-sectional view taken along line 7-7 of FIG. 1.

A protrusion 55 located below magnet 54 extends towards bottom portion 58 to define the gap 61 for receipt of the brim of the cap. The two elongated portions 57 located on opposite sides of opening 59, define two contact points along with a third contact point formed by protrusion 55 to engage the brim of the cap. The opening 55 allows receipt of the plate 32 when the clip assembly is collapsed as shown in FIG. 7. The protrusion 55, being spaced from the elongated portions, allows the natural curvature of the brim of the cap to be maintained while the brim is held in position by the bias created between the three contact points and the two portions 56, 58 of the clip assembly.

Figure 8:
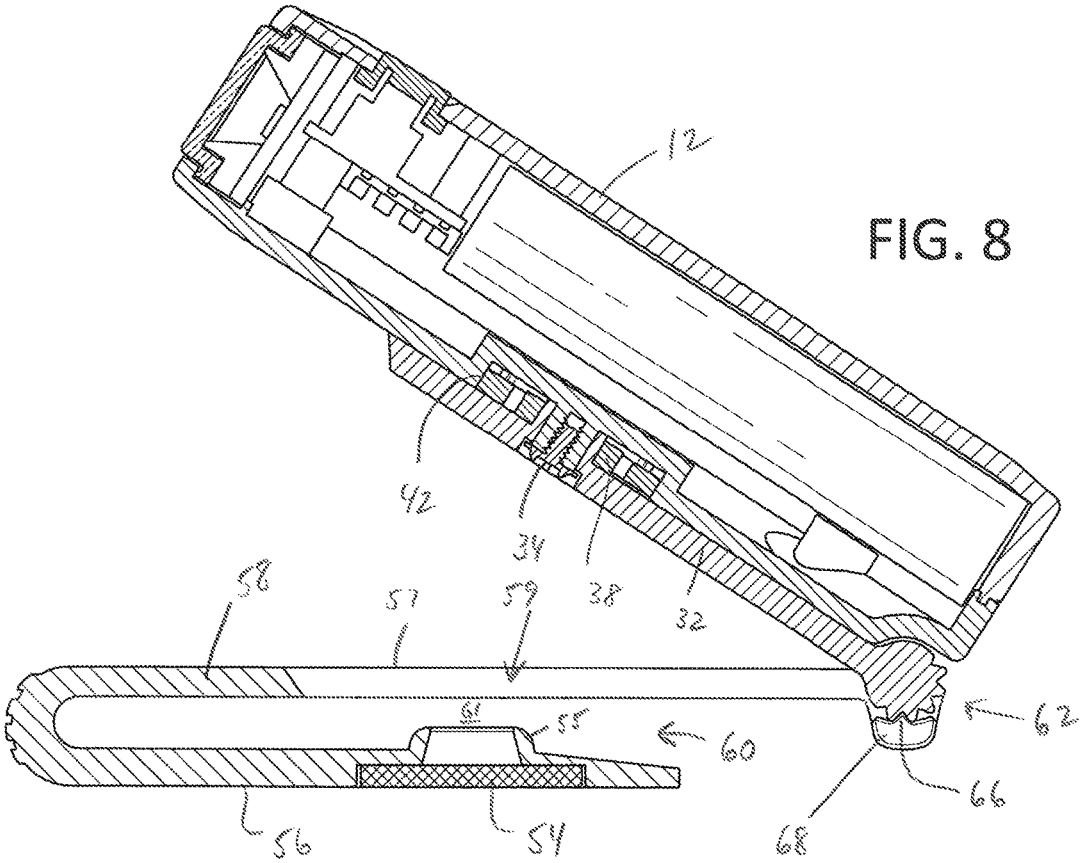
FIG. 8 is a cross-sectional view taken along line 8-8 of FIG. 4.

The clip portion 52 and the clip plate 32 are divergent from each other at one end by a ratchet and pawl assembly as shown in FIGS. 7 and 8, when assembled, and in FIGS. 5 and 6 in exploded views. The teeth 64 of one end of the plate 32 are engaged by a pointed projection 66 extending from inwardly projecting arms 68 of the portion 52 of the clip 14. The spacing between the teeth 64 allows movement of the portion 52 of the clip 14 through incremental movements of 30° at a time. The arms 68 include openings 70 which receive pins 72 of the plate 32 for pivotally mounting of the clip portion 52 on the plate 32 of the clip assembly 14.

The interior of the flashlight body, as shown in FIGS. 7 and 8, includes a battery 74, a printed circuit board 76 and a power button 78 as controlled by depression of power button cover 24. LED 22 is surrounded by a light reflector 84 projection of light through a lens 82.

Figure 9:
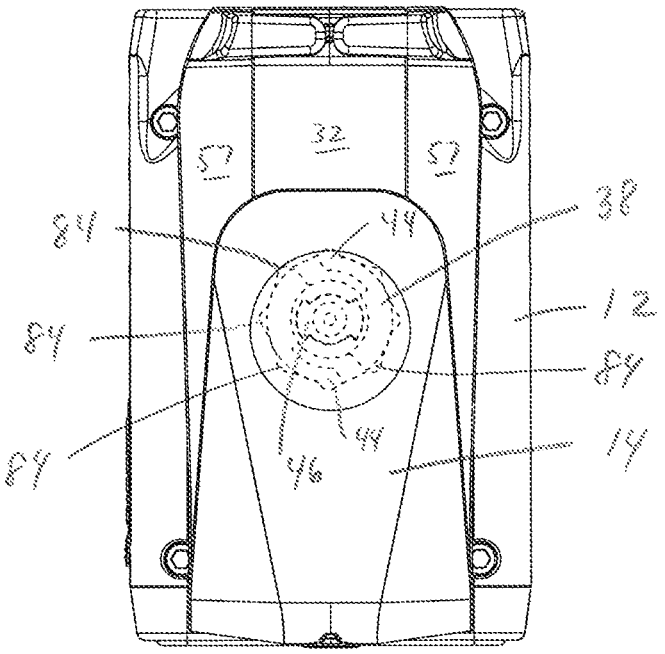
FIG. 9 is a top view illustrating the clip mounted onto the flashlight body.
Figure 10:
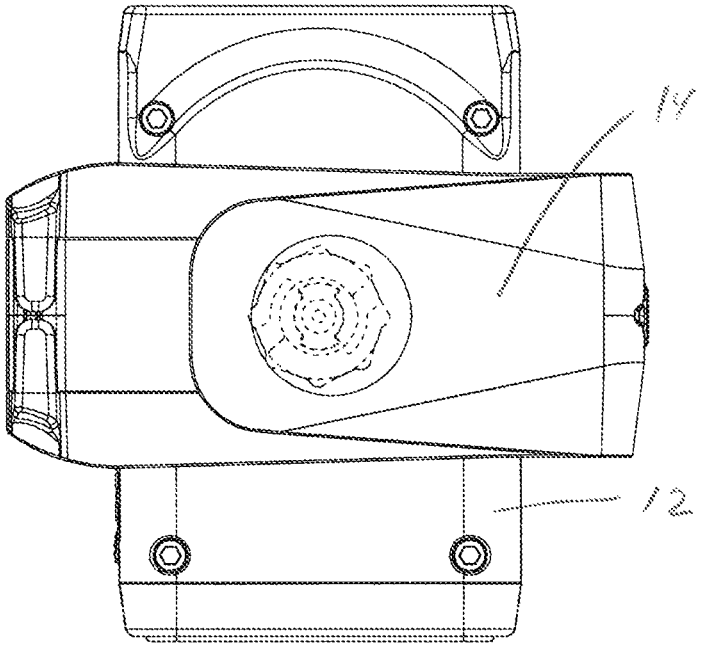
FIG. 10 illustrates a shifting of the clip by 90° with respect to the flashlight body as compared to FIG. 9.

As should be noted with reference to FIGS. 9 and 10, the clip assembly 14 is movable in a single plane with respect to the flashlight body 12. FIG. 10 illustrates a 90° rotation of the clip assembly with respect to the flashlight body. As shown in dotted lines, the snap ring 38 seated on projection 46 causes the free ends 44 of the snap ring to move, in 45° implements, through detents 84 about the periphery of the outer surface 42 of the recess 40.

The clip assembly 14 is also pivotable at one end with respect to the flashlight body 12. This provides various angles of inclination for the flashlight body when the clip assembly 14 is mounted on a flat surface as shown in FIGS. 4 and 8. Similarly, when the clip assembly is mounted on the brim of a hat, the flashlight body may be pivoted away from the clip assembly for changing an angle of inclination of the illuminating light. The light source may also be directed towards an object of the clip assembly on a metallic object by magnet 54.

The foregoing description should be considered as illustrative only of the principles of the invention. Since numerous modifications and changes will readily occur to those skilled in the art, it is not desired to limit the invention to the exact construction and operation shown and described, and, accordingly, all suitable modifications and equivalents may be resorted to, falling within the scope of the invention.

We claim:

1. A flashlight comprising
a body having a light source, and
a clip assembly mounted on said body, said clip assembly including a plate portion and a U-shaped portion;
said plate portion being rotatably mounted on said body about a rotation axis, said rotation axis extending perpendicular to a longitudinal axis of said body,
said U-shaped portion being pivotally mounted on said plate portion about a pivot axis, said pivot axis extending perpendicular to said rotation axis,
said clip assembly being thereby rotatably mounted and pivotally mounted with respect to the body for directing the light source in a desired direction.

2. A flashlight comprising
a body having a light source, and
a clip assembly mounted on said body,
said clip assembly being rotatably mounted and pivotally mounted with respect to the body for directing the light source in a desired direction,
a plate of the clip assembly being rotatably mounted on the body and a U-shaped portion of the clip assembly being pivotally mounted at one end on the plate,
one leg of two legs of the U-shaped portion including a magnet,
the other leg of the U-shaped portion being pivotally mounted on the plate by a ratchet and pawl assembly.

3. The flashlight according to claim 2, wherein the ratchet and pawl assembly varies a position of the U-shaped portion with respect to the plate by 30° increments.

4. The flashlight according to claim 2, wherein the plate is rotatably mounted on the body by a snap ring secured to the plate.

5. The flashlight according to claim 4, wherein the snap ring is rotatably mounted in a recess of the body.

6. The flashlight according to claim 5, wherein the snap ring in the recess varies a position of the plate with respect to the body by 45° increments.

7. The flashlight according to claim 2, wherein a gap formed between the two legs of the U-shaped portion accommodates a fit of a brim of a cap with a bias therebetween to hold the U-shaped portion on the brim.

8. The flashlight according to claim 7, wherein the gap is located between a protrusion extending from one of the two legs towards an opposed surface located on the other of the two legs.

9. A flashlight comprising
a body having a light source at one end of the housing, and
a clip assembly mounted on said body, said clip assembly including a plate portion and a U-shaped portion;
said plate portion being rotatably mounted on said body about a rotation axis, said rotation axis extending perpendicular to a longitudinal axis of said body,
said U-shaped portion being pivotally mounted on said plate portion about a pivot axis, said pivot axis extending perpendicular to said rotation axis,
said clip assembly being thereby rotatably mounted with respect to the body about a central portion of the body and said clip assembly being pivotally mounted about one end of the clip assembly for directing the light source in a desired direction.

10. The flashlight according to claim 9, wherein one leg of two legs of the U-shaped portion includes a magnet.

11. The flashlight according to claim 10, wherein the other leg of the U-shaped portion is pivotally mounted on the plate by a ratchet and pawl assembly.

12. The flashlight according to claim 11, wherein the ratchet and pawl assembly varies a position of the U-shaped portion with respect to the plate by 30° increments.

13. The flashlight according to claim 9, wherein the plate portion is rotatably mounted on the body by a snap ring secured to the plate.

14. The flashlight according to claim 13, wherein the snap ring is rotatably mounted in a recess of the body.

15. The flashlight according to claim 14, wherein the snap ring in the recess varies a position of the plate with respect to the body by 45° increments.

16. The flashlight according to claim 9, wherein a gap formed between two legs of the u-shaped portion accommodates a fit of a brim of a cap with a bias therebetween to hold the U-shaped portion on the brim.

17. The flashlight according to claim 16, wherein the gap is located between a protrusion extending from one of the two legs towards an opposed surface located on the other of the two legs.

* * * * *